US009187830B2

(12) United States Patent
Yamazaki et al.

(10) Patent No.: US 9,187,830 B2
(45) Date of Patent: Nov. 17, 2015

(54) NON-ORIENTED ELECTRICAL STEEL SHEET AND MANUFACTURING METHOD THEREOF

(75) Inventors: Shuichi Yamazaki, Tokyo (JP); Takeshi Kubota, Tokyo (JP); Yousuke Kurosaki, Tokyo (JP); Masahiro Fujikura, Tokyo (JP); Takahide Shimazu, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 285 days.

(21) Appl. No.: 13/577,946

(22) PCT Filed: Feb. 15, 2011

(86) PCT No.: PCT/JP2011/053096

§ 371 (c)(1), (2), (4) Date: Aug. 9, 2012

(87) PCT Pub. No.: WO2011/102328

PCT Pub. Date: Aug. 25, 2011

(65) Prior Publication Data

US 2012/0305140 A1 Dec. 6, 2012

(30) Foreign Application Priority Data

Feb. 18, 2010 (JP) ..... 2010-033937

(51) Int. Cl.
*H01F 1/18* (2006.01)
*C23C 8/10* (2006.01)
(Continued)

(52) U.S. Cl.
CPC . *C23C 24/00* (2013.01); *C21D 8/12* (2013.01); *C21D 9/46* (2013.01); *C22C 38/02* (2013.01); *C22C 38/04* (2013.01); *C22C 38/06* (2013.01); *C23C 8/10* (2013.01); *C23C 8/18* (2013.01); *C23C 22/74* (2013.01); *C23C 28/00* (2013.01); *H01F 1/18* (2013.01)

(58) Field of Classification Search
CPC ..... C23C 8/10; C23C 8/18; C23C 22/74; C23C 28/00; C23C 24/00; C21D 8/12; C21D 9/46; C22C 38/02; C22C 38/04; C22C 38/06; H01F 1/18
See application file for complete search history.

(56) References Cited

U.S. PATENT DOCUMENTS 5,753,051 A 5/1998 Kanai et al.
5,803,988 A 9/1998 Bae et al.
(Continued)

FOREIGN PATENT DOCUMENTS

CN 1461357 12/2003
CN 101223300 7/2008
(Continued)

OTHER PUBLICATIONS

Chinese Office Action dated Mar. 29, 2013, issued in corresponding Chinese Application No. 201180009924.2, with a summary of the Office Action in English.
(Continued)

*Primary Examiner* — Lois Zheng
(74) *Attorney, Agent, or Firm* — Kenyon & Kenyon LLP

(57) ABSTRACT

A non-oriented electrical steel sheet includes: a base iron (1); and a tension applying type insulating film (2) of not less than 1 g/m$^2$ nor more than 6 g/m$^2$ on a surface of the base iron (1). An oxide layer (3) containing at least one type of oxide selected from the group consisting of Si, Al, and Cr and having a thickness of not less than 0.01 μm nor more than 0.5 μm is formed on the surface of the base iron (1).

6 Claims, 4 Drawing Sheets

(51) Int. Cl.

| | |
|---|---|
| ***C23C 24/00*** | (2006.01) |
| ***C21D 8/12*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C23C 8/18*** | (2006.01) |
| ***C23C 22/74*** | (2006.01) |
| ***C23C 28/00*** | (2006.01) |

(56) References Cited

U.S. PATENT DOCUMENTS

| | | | | |
|---|---|---|---|---|
| 5,945,212 | A | 8/1999 | Tanaka et al. | |
| 6,322,688 | B1 * | 11/2001 | Yamazaki et al. | 205/320 |
| 6,713,187 | B2 | 3/2004 | Shigesato et al. | |
| 7,850,792 | B2 | 12/2010 | Tanaka et al. | |
| 2006/0185767 | A1 | 8/2006 | Arita et al. | |

FOREIGN PATENT DOCUMENTS

| | | | | |
|---|---|---|---|---|
| JP | 50-015013 | | 6/1975 | |
| JP | 55-073819 | | 6/1980 | |
| JP | 56-055574 | | 5/1981 | |
| JP | 58-110679 | | 7/1983 | |
| JP | 60-131976 | | 7/1985 | |
| JP | 60-152681 | | 8/1985 | |
| JP | 06-065754 | | 3/1994 | |
| JP | 06-065755 | | 3/1994 | |
| JP | 06-184762 | | 7/1994 | |
| JP | 06-330338 | | 11/1994 | |
| JP | 11-209891 | | 8/1999 | |
| JP | 11-222653 | * | 8/1999 | C22C 38/00 |
| JP | 2001-140018 | | 5/2001 | |
| JP | 2001-279400 | | 10/2001 | |
| JP | 2004-332042 | | 11/2004 | |
| JP | 2006-265720 | | 10/2006 | |
| JP | 2008-031499 | | 2/2008 | |
| JP | 2008-260996 | | 10/2008 | |

OTHER PUBLICATIONS

International Preliminary Report on Patentability dated Sep. 27, 2012 issued in corresponding PCT Application No. PCT/JP2011/053096.
International Search Report dated May 17, 2011, issued in corresponding PCT Application No. PCT/JP2011/053096.
Extended European Search Report dated Mar. 30, 2015, issued in corresponding European Application No. 11744614.6.

* cited by examiner

NON-ORIENTED ELECTRICAL STEEL SHEET AND MANUFACTURING METHOD THEREOF

This application is a national stage application of International Application No. PCT/JP2011/053096, filed Feb. 15, 2011, which claims priority to Japanese Application No. 2010-033937, filed Feb. 18, 2010, the content of which is incorporated by reference herein in its entirety.

TECHNICAL FIELD

The present invention relates to a non-oriented electrical steel sheet suitable for an iron core material of a motor and a manufacturing method thereof.

BACKGROUND ART

Making an electrical apparatus more efficient has been desired strongly, and a further achievement of lower core loss has been required for a non-oriented electrical steel sheet used for an iron core material of a motor contained in an electrical apparatus. Then, there have been studied a technique of containing Si, Al, and so on in a non-oriented electrical steel sheet to increase resistivity and increase a grain diameter, a technique of adjusting hot-rolled sheet annealing and a cold rolling ratio to thereby improve texture, and so on.

Further, a non-oriented electrical steel sheet is an electrical steel sheet having random crystal orientations in the direction parallel to its surface, but depending on the use of a non-oriented electrical steel sheet, there is also sometimes a case that one having a magnetic property in one direction parallel to its surface, for example, a rolling direction more excellent than that in the other direction is preferable. For example, in the case when a divided core is used as a stator of a motor, the electrical steel sheet as described above is preferably used for the divided core. As an electrical steel sheet having an excellent magnetic property in the rolling direction, a grain-oriented electrical steel sheet is also considered, but a glass coating film exists on surfaces of the grain-oriented electrical steel sheet, so that punching is difficult to be performed. Further, as compared to the non-oriented electrical steel sheet, more controls are required for manufacturing the grain-oriented electrical steel sheet, and the grain-oriented electrical steel sheet is expensive. Incidentally, in the case of the divided core being used as a stator of a motor, the direction of easy magnetized of the electrical steel sheet is allowed to agree with the direction in which the magnetic flux flows, and thus the efficiency of the motor can be improved. Further, it is possible to improve the yield of the electrical steel sheet being a material and to increase a winding filling factor.

Various proposals regarding the non-oriented electrical steel sheet for a divided core have been made. However, in conventional techniques, it is difficult to obtain the sufficient magnetic property in the rolling direction.

CITATION LIST

Patent Literature

Patent Literature 1: Japanese Laid-open Patent Publication No. 2004-332042

Patent Literature 2: Japanese Laid-open Patent Publication No. 2006-265720

Patent Literature 3: Japanese Laid-open Patent Publication No. 2008-260996

Patent Literature 4: Japanese Laid-open Patent Publication No. 56-55574

Patent Literature 5: Japanese Laid-open Patent Publication No. 2001-140018

Patent Literature 6: Japanese Laid-open Patent Publication No. 2001-279400

SUMMARY OF INVENTION

Technical Problem

The present invention has an object to provide a non-oriented electrical steel sheet capable of obtaining a better magnetic property in a rolling direction, and a manufacturing method thereof.

Solution to Problem

The present inventors focused on the technique disclosed in Patent Literature 4 and thought that by using a tension applying type insulating film as an insulating film formed on surfaces of a base iron of a non-oriented electrical steel sheet, it may be possible to improve the magnetic property in the rolling direction, and conducted various experiments. However, it turned out that in the case when the tension applying type insulating film is simply used, the insulating film cannot sufficiently resist various workings (punching, interlocking, and so on) for forming a divided core. That is, peeling off of the insulating film or the like sometimes occurs. Further, the magnetic property in the rolling direction was improved, but the improvement was not sufficient. The present inventors conducted an earnest study in order to examine these causes, and then found that adhesiveness between the tension applying type insulating film and the base iron is low, and due to that, sufficient tension does not act on the base iron. Then, the present inventors further conducted an earnest study based on the knowledge, and then found that in the case of a specific oxide layer existing on the surfaces of the base iron, the oxide layer contributes to the improvement of the adhesiveness between the base iron and the tension applying type insulating film, and the magnetic property in the rolling direction is significantly improved. Further, it was also found that with the improvement of the adhesiveness, peeling off of the insulating film or the like is suppressed.

The gist of the present invention is as follows.

(1) A non-oriented electrical steel sheet including:

a base iron, an oxide layer containing at least one type of oxide selected from the group consisting of Si, Al, and Cr and having a thickness of not less than 0.01 μm nor more than 0.5 μm being formed on a surface of the base iron; and a tension applying type insulating film of not less than 1 $g/m^2$ nor more than 6 $g/m^2$ on the surface of the base iron, wherein the base iron contains:

Si, Al, and Cr: not less than 2 mass % nor more than 6 mass % in total content; and Mn: not less than 0.1 mass % nor more than 1.5 mass %, a content of C of the base iron is equal to or less than 0.005 mass %, and a balance of the base iron is composed of Fe and inevitable impurities.

(2) The non-oriented electrical steel sheet according to (1), wherein the total content of Al and Cr of the base iron is equal to or more than 0.8 mass %.

(3) The non-oriented electrical steel sheet according to (1) or (2), wherein the insulating film is formed by baking of a coating solution containing phosphate and colloidal silica.

(4) The non-oriented electrical steel sheet according to (1) or (2), wherein the insulating film is formed by baking of a coating solution containing boric acid and an alumina sol.

(5) A manufacturing method of a non-oriented electrical steel sheet including:

performing finish annealing of a cold-rolled steel strip; and forming a tension applying type insulating film of not less than 1 $g/m^2$ nor more than 6 $g/m^2$ on a surface of the cold-rolled steel strip, wherein the cold-rolled steel strip contains:

Si, Al, and Cr: not less than 2 mass % nor more than 6 mass % in total content; and Mn: not less than 0.1 mass % nor more than 1.5 mass %, a content of C of the cold-rolled steel strip is equal to or less than 0.005 mass %, a balance of the cold-rolled steel strip is composed of Fe and inevitable impurities, and the performing the finish annealing includes forming an oxide layer containing at least one type of oxide selected from the group consisting of Si and Al and having a thickness of not less than 0.01 μm nor more than 0.5 μm on the surface of the cold-rolled steel strip with setting a temperature of the cold-rolled steel strip to not lower than 800° C. nor higher than 1100° C. in an atmosphere where when the total content of Si and Al of the cold-rolled steel strip is represented as X (mass %), a partial pressure ratio of water vapor to hydrogen is equal to or less than $0.005 \times X^2$.

(6) The manufacturing method of a non-oriented electrical steel sheet according to (5), wherein the forming the insulating film includes, after the performing the finish annealing:

applying a coating solution to the surface of the cold-rolled steel strip; and performing baking of the coating solution with setting the temperature of the cold-rolled steel strip to not lower than 800° C. nor higher than 1100° C.

(7) The manufacturing method of a non-oriented electrical steel sheet according to (5), wherein the forming the insulating film includes:

applying a coating solution to the surface of the cold-rolled steel strip before the performing the finish annealing; and performing baking of the coating solution during the finish annealing.

(8) The manufacturing method of a non-oriented electrical steel sheet according to (6) or (7), wherein the coating solution contains phosphate and colloidal silica.

(9) The manufacturing method of a non-oriented electrical steel sheet according to (6) or (7), wherein the coating solution contains boric acid and an alumina sol.

(10) The manufacturing method of a non-oriented electrical steel sheet according to any one of (5) to (9), wherein the total content of Al and Cr of the cold-rolled steel strip is equal to or more than 0.8 mass %.

Advantageous Effects of Invention

According to the present invention, it is possible to obtain high adhesiveness between a base iron and a tension applying type insulating film, and to significantly improve a magnetic property in a rolling direction.

DESCRIPTION OF EMBODIMENTS

First, an experiment regarding the application of a tension applying type insulating film to a non-oriented electrical steel sheet, conducted by the present inventors will be explained.

In the experiment, two cold-rolled steel strips for a non-oriented electrical steel sheet each containing Si: 3 mass %, Mn: 0.15 mass %, and Al: 1.2 mass %, and a balance being composed of Fe and inevitable impurities and each having a thickness of 0.35 mm were manufactured. Then, finish annealing at 1000° C. was performed in an annealing atmosphere different in every cold-rolled steel strip. In one annealing atmosphere, a partial pressure ratio of water vapor to hydrogen ($P_{H2O}/P_{H2}$) was set to 0.01, and in the other annealing atmosphere, the partial pressure ratio ($P_{H2O}/P_{H2}$) was set to 0.1. Then, a core loss value (W10/50) under an excitation condition of the frequency being 50 Hz and the maximum magnetic flux density being 1.0 T was measured in a rolling direction (an L direction) and a direction perpendicular to the rolling direction in a surface of the cold-rolled steel strip (a C direction). Thereafter, 3 $g/m^2$ per one surface of a coating solution composed of aluminum phosphate, colloidal silica, and chromic acid was applied to both the surfaces of each of the steel strips to be baked at 800° C. That is, tension applying type insulating films were formed. Then, the core loss value (W10/50) was measured again in the L direction and the C direction. These results are listed in Table 1.

TABLE 1

| | PARTIAL PRESSURE RATIO ($P_{H2O}/P_{H2}$) | | | |
|---|---|---|---|---|
| | 0.1 | | 0.01 | |
| EXITATION DIRECTION | L DIRECTION | C DIRECTION | L DIRECTION | C DIRECTION |
| CORE LOSS BEFORE FORMING INSULATING FILM (W10/50 (W/kg)) | 0.894 | 0.961 | 0.883 | 0.974 |

TABLE 1-continued

| | PARTIAL PRESSURE RATIO ($P_{H2O}/P_{H2}$) | | | |
|---|---|---|---|---|
| | 0.1 | | 0.01 | |
| EXITATION DIRECTION | L DIRECTION | C DIRECTION | L DIRECTION | C DIRECTION |
| CORE LOSS AFTER FORMING INSULATING FILM (W10/50 (W/kg)) | 0.821 | 0.971 | 0.736 | 0.977 |
| CORE LOSS IMPROVEMENT RATE BETWEEN BEFORE AND AFTER FORMING INSULATING FILM | 8.20% | −1.00% | 16.70% | −0.30% |

As listed in Table 1, in the case of annealing in the atmosphere of the partial pressure ratio ($P_{H2O}/P_{H2}$) being 0.1, an improvement of 8% or so was confirmed with respect to the core loss in the L direction. However, when a divided core was desired to be formed from the non-oriented electrical steel sheet provided with the insulating films formed in this manner, the insulating films were not able to resist workings such as punching and interlocking.

On the other hand, in the case of annealing in the atmosphere of the partial pressure ratio ($P_{H2O}/P_{H2}$) being 0.01, an improvement as high as 17% was confirmed with respect to the core loss in the L direction, and further the insulating films were able to sufficiently resist workings such as punching and interlocking.

Figure 1A:
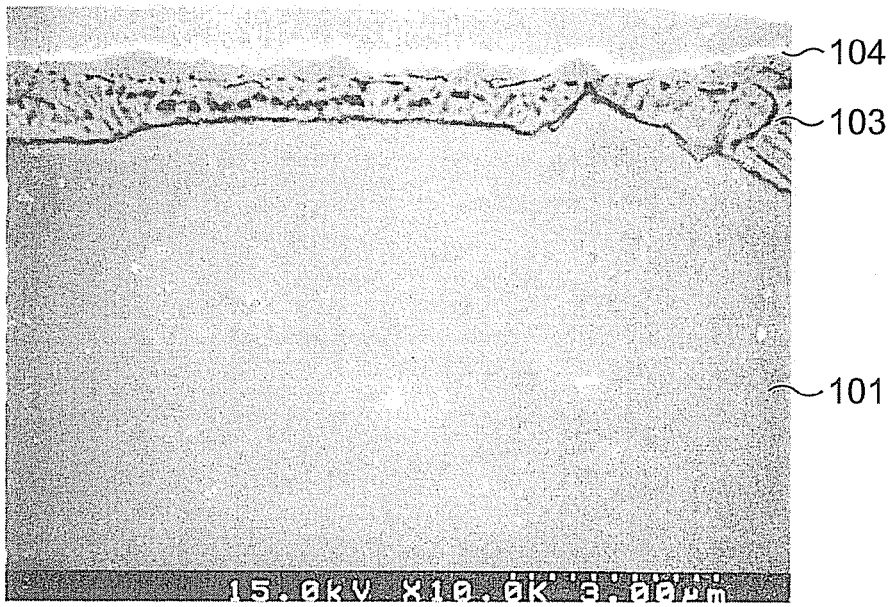
FIG. 1A is a view showing a scanning electron microscope cross-sectional photograph of an oxide on a surface of a steel strip having had finish annealing performed thereon in an atmosphere of a partial pressure ratio ($P_{H2O}/P_{H2}$) being 0.1.
Figure 1B:
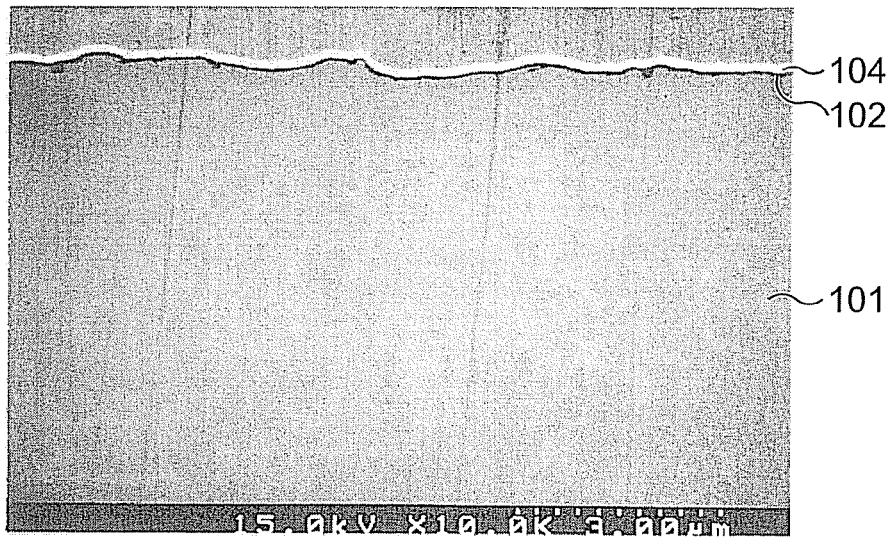
FIG. 1B is a view illustrating a scanning electron microscope cross-sectional photograph of an oxide on a surface of a steel strip having had finish annealing performed thereon in an atmosphere of the partial pressure ratio ($P_{H2O}/P_{H2}$) being 0.01.

The present inventors observed the cross section of an oxide on the surface of the steel strip after the finish annealing in order to examine the cause of the working resistance difference of the insulating films due to the finish annealing atmosphere described above. FIG. 1A illustrates a scanning electron microscope cross-sectional photograph of an oxide on the surface of the steel strip having had the finish annealing performed thereon in the atmosphere of the partial pressure ratio ($P_{H2O}/P_{H2}$) being 0.1, and FIG. 1B illustrates a scanning electron microscope cross-sectional photograph of an oxide on the surface of the steel strip having had the finish annealing performed thereon in the atmosphere of the partial pressure ratio ($P_{H20}/P_{H2}$) being 0.01.

As illustrated in FIG. 1A, on the surface of a base iron 101 of the steel strip having had the finish annealing performed thereon in the atmosphere of the partial pressure ratio ($P_{H2O}/P_{H2}$) being 0.1, a thick internal oxide layer 103 existed. On the other hand, as illustrated in FIG. 1B, on the surface of a base iron 101 of the steel strip having had the finish annealing performed thereon in the atmosphere of the partial pressure ratio ($P_{H20}/P_{H2}$) being 0.01, a thin external oxide film 102 having a thickness of 50 nm or so existed. Incidentally, a Au deposited layer 104 existing on the external oxide film 102 and the internal oxide layer 103 was formed for protecting the external oxide film 102 and the internal oxide layer 103 when making samples for the cross section observation.

Figure 2:
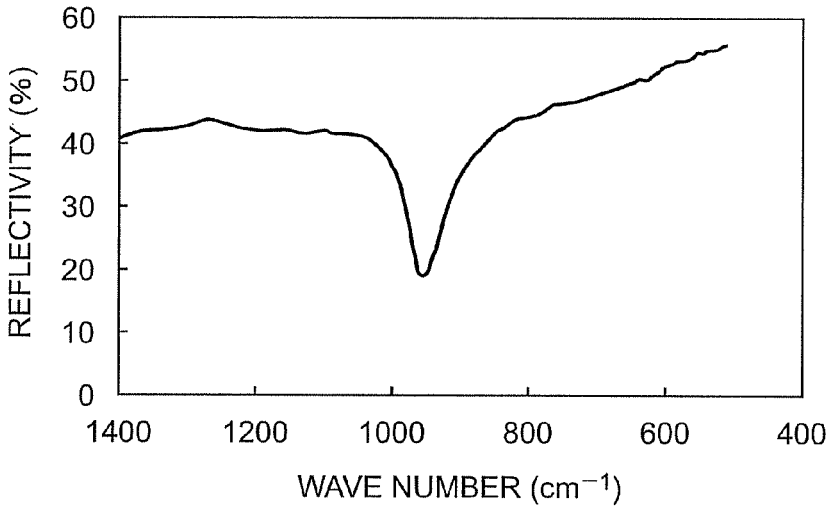
FIG. 2 is a view illustrating an infrared reflection-absorption spectrum of an external oxide film 102.

Further, FIG. 2 illustrates an infrared reflection-absorption spectrum of the external oxide film 102. From the spectrum illustrated in FIG. 2, it was possible to confirm that the external oxide film 102 is mainly made of $Al_2O_3$.

From the above, it was found that in manufacturing the non-oriented electrical steel sheet, the external oxide film is formed at the time of finish annealing of the cold-rolled steel strip and thereafter the tension applying type insulating film is formed, and thereby adhesiveness between the insulating film and the base iron is improved significantly and further the magnetic property in the L direction is improved significantly. Incidentally, as will be described later, even though the application of the raw material (coating solution) of the tension applying type insulating film is performed and then the finish annealing is performed, and thereby the formation of the external oxide film and the formation of the insulating film by baking of the coating solution are performed in parallel, the improvement of the adhesiveness and the significant improvement of the magnetic property in the L direction are achieved.

Figure 3:
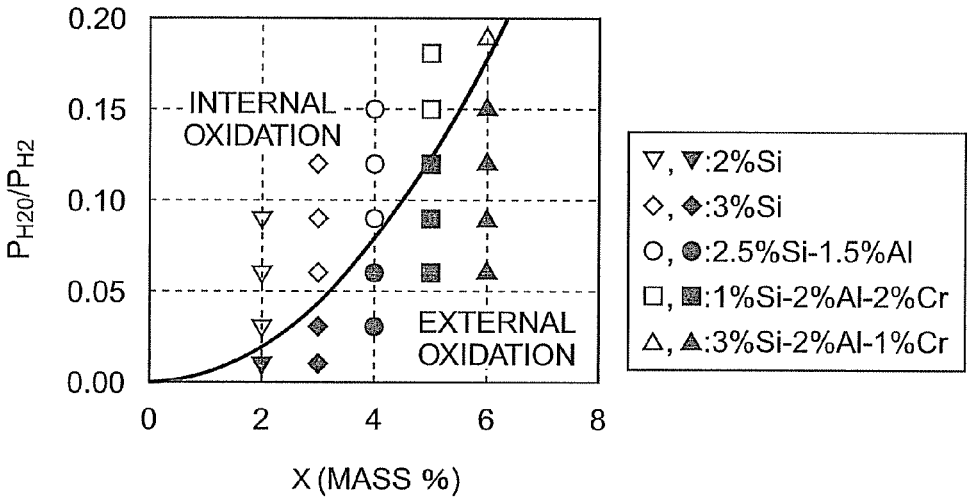
FIG. 3 is a view illustrating the relationship between a composition of a cold-rolled steel strip and an atmosphere of finish annealing, and a state of a surface of a base iron.

Here, the annealing condition is important for forming the external oxide film during finish annealing. Then, the present inventors examined the relationship between the composition of the cold-rolled steel strip to be finish annealed and the atmosphere of finish annealing, and the state of the surface of the base iron. In the examination, various cold-rolled steel strips different in the total content (X (mass %)) of Si, Al, and Cr were manufactured to be subjected to finish annealing under atmospheres of the various partial pressure ratios ($P_{H2O}/P_{H2}$). Then, the state of a surface of each of base irons after the finish annealing was observed. Incidentally, the temperature of the finish annealing was set to 900° C. The result is illustrated in FIG. 3. In FIG. 3, the open mark signifies that the internal oxide layer was formed, and the closed mark signifies that the external oxide film was formed.

From FIG. 3, it is found that as long as the total content (X (mass %)) of Si, Al, and Cr is under the condition that the partial pressure ratio ($P_{H2O}/P_{H2}$) is less than $0.005\times X^2$, the external oxide film can be formed.

Figure 4:
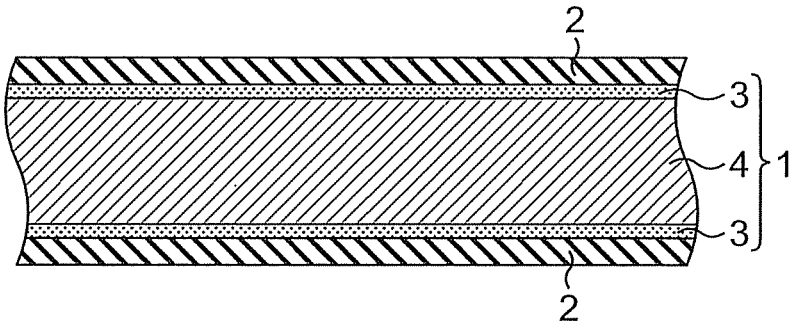
FIG. 4 is a cross-sectional view illustrating a structure of a non-oriented electrical steel sheet according to an embodiment of the present invention.

Hereinafter, an embodiment of the present invention will be explained with reference to the attached drawings. FIG. 4 is a cross-sectional view illustrating the structure of a non-oriented electrical steel sheet according to the embodiment of the present invention.

As illustrated in FIG. 4, in the non-oriented electrical steel sheet according to the embodiment, a tension applying type insulating film 2 having not less than 1 g/m$^2$ nor more than 6 g/m$^2$ is formed on surfaces of a base iron 1. Further, on the surfaces of the base iron 1, an external oxide film 3 containing at least one type of oxide selected from the group consisting of Si, Al, and Cr and having a thickness of not less than 0.01 μm nor more than 0.5 μm is formed. In the base iron 1, a base 4 and the external oxide films 3 are contained. The external oxide film 3 is one example of an oxide layer.

The base iron 1 contains Si, Al, and Cr: not less than 2 mass % nor more than 6 mass % in total content and Mn: not less than 0.1 mass % nor more than 1.5 mass %. The content of C in the base iron 1 is equal to or less than 0.005 mass %, and the balance of the base iron 1 may be composed of Fe and inevitable impurities.

Figure 5:
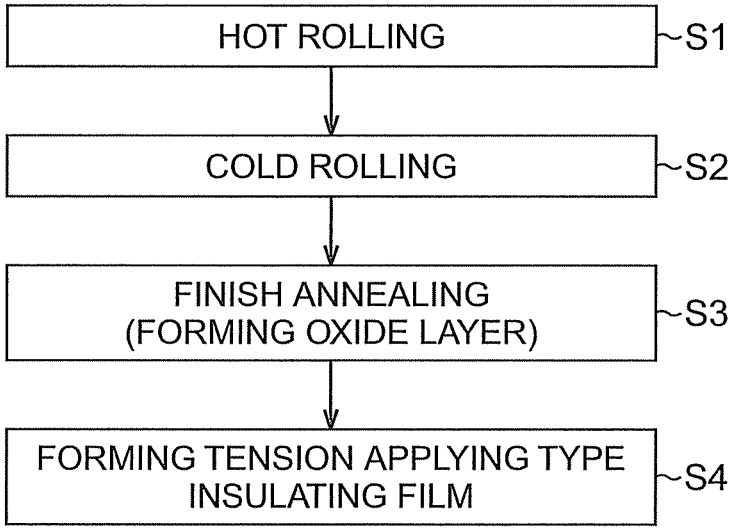
FIG. 5 is a flowchart illustrating an example of a manufacturing method of a non-oriented electrical steel sheet.

Next, a manufacturing method of the non-oriented electrical steel sheet as above will be explained. FIG. 5 is a flowchart illustrating an example of the manufacturing method of the non-oriented electrical steel sheet.

In the embodiment, first, hot rolling of a slab (steel material) having a predetermined composition heated to a predetermined temperature is performed to manufacture a hot-rolled steel strip (Step S1). Next, scales are removed by acid pickling, and cold rolling of the hot-rolled steel strip is performed to manufacture a cold-rolled steel strip (Step S2). As the cold rolling, the cold rolling may be performed only one time, or the cold rolling may also be performed two times or more with intermediate annealing being interposed therebetween. Incidentally, annealing may also be performed as necessary before the cold rolling.

Here, the components contained in the slab (steel material) will be explained.

C increases the core loss and causes magnetic aging. Thus, the content of C is set to 0.005 mass % or less.

Si, Al, and Cr exhibit an effect of increasing the resistivity of the non-oriented electrical steel sheet to decrease eddy current loss. Further, Si, Al, and Cr are used for forming the external oxide film 3, of which the detail will be described later. If the total content of Si, Al, and Cr is less than 2 mass %, the effects cannot be obtained sufficiently. Thus, the total content of Si, Al, and Cr is set to 2 mass % or more. If the total content of Si, Al, and Cr is in excess of 6 mass %, cold working such as cold rolling is difficult to be performed. Thus, the total content of Si, Al, and Cr is set to 6 mass % or less.

Mn exhibits an effect of decreasing solid solution S at the time of slab heating. If the content of Mn is less than 0.1 mass %, the effect cannot be obtained sufficiently. Thus, the content of Mn is set to 0.1 mass % or more. On the other hand, if the content of Mn is in excess of 1.5 mass %, the magnetic property deteriorates. Thus, the content of Mn is set to 1.5 mass % or less.

Incidentally, the content of inevitable impurities such as S, N, and O, and Ti, V, Zr, and Nb having the potential to bond to S, N and O to thereby form non-magnetic inclusions may be decreased as much as possible. Further, rare-earth elements, Ca, and so on may also be contained in order to scavenge S, N, and O. The preferable content of rare-earth elements, Ca, and so on is not less than 0.002 mass % nor more than 0.01 mass %.

Sn and Sb have an effect of improving the property in the L direction by the improvement of texture. By adding Sn and Sb, the synergistic effect with the effect by the present invention can be expected.

After the cold rolling (Step S2), finish annealing of the cold-rolled steel strip is performed in a predetermined atmosphere to manufacture the base iron 1 with the external oxide film 3 on the surfaces (Step S3). In the finish annealing, the temperature of the cold-rolled steel strip is set to not lower than 800° C. nor higher than 1100° C. If the temperature is lower than 800° C., it is difficult to sufficiently form the external oxide films 3. On the other hand, if the temperature is in excess of 1100° C., the cost is increased significantly, and the stable operation is difficult to be performed. Further, as the atmosphere of the finish annealing, in consideration of the above-described knowledge, the partial pressure ratio ($P_{H2O}/P_{H2}$) of water vapor to hydrogen is set to less than $0.005\times X^2$ with respect to the total content (X (mass %)) of Si, Al, and Cr. As long as the condition is satisfied, a desired external oxide film can be formed as an oxide layer 3 as described above. The external oxide film 3 contributes to the significant improvement of the adhesiveness between the tension applying type insulating film 2 and the base iron 1. Then, with the improvement of the adhesiveness, tension acts effectively and the magnetic property in the L direction is further improved.

Incidentally, if the thickness of the external oxide film 3 is less than 0.01 μm, it is difficult to obtain the sufficient adhesiveness. Thus, the thickness of the external oxide film 3 is desirably equal to or more than 0.01 μm. Further, also in the case of the thickness of the external oxide film 3 being in excess of 0.5 μm, it is difficult to obtain the sufficient adhesiveness. This is supposed because if the external oxide films 3 are formed thickly, unnecessary stress thereby occurs on the surfaces of the base 4 of the base iron 1. Thus, the thickness of the external oxide film 3 is desirably equal to or less than 0.5 μm. The thickness of the external oxide film 3 may be controlled by adjusting, for example, the temperature of the finish annealing and a soaking time. That is, as the soaking temperature is higher and the soaking time is longer, the external oxide films 3 are formed thickly.

The substances composing the external oxide film 3 are determined according to each of the contents of Si, Al, and Cr, and the main component of the external oxide film 3 may be, for example, $SiO_2$, $Al_2O_3$, $Cr_2O_3$, and so on. In the case when Al and Cr in the cold-rolled steel strip are small, for example, the main component of the external oxide film 3 is $SiO_2$, and if the total content of Al and Cr is equal to or more than 0.8 mass %, the main component of the external oxide film 3 is $Al_2O_3$ and $Cr_2O_3$, or $(Al, Cr)_2O_3$. The main component of the external oxide film 3 is not limited in particular. In the case when the main component is $Al_2O_3$ and $Cr_2O_3$, or $(Al, Cr)_2O_3$, the high adhesiveness can be obtained in particular. Thus, the total content of Al and Cr is desirably equal to or more than 0.8 mass %. Incidentally, the external oxide film 3 is not composed of only these main components, and even in the case of Al and Cr being small, $Al_2O_3$, $Cr_2O_3$, and so on are sometimes contained, and even in the case of the total content of Al and Cr being in excess of 0.8 mass %, $SiO_2$ may be contained.

After the finish annealing and the formation of the oxide layer (Step S3), the tension applying type insulating film 2 is formed on the surfaces of the base iron 1 (Step S4). In the formation of the insulating films 2, application and baking of a predetermined coating solution are performed. As the coating solution, a coating solution used for a grain-oriented electrical steel sheet may be used. For example, a coating solution containing phosphate and colloidal silica as its main component may be used. The ratio of phosphate and colloidal silica are not limited in particular. The ratio of colloidal silica is preferably 4 mass % to 24 mass %, and the ratio of phosphate is preferably 5 mass % to 30 mass %. A coating solution like that is described in, for example, Japanese Laid-open Patent Publication No. 48-39338, Japanese Laid-open Patent Publication No. 50-79442, and so on. Further, a coating solution containing boric acid and an alumina sol as its main component may also be used. The component ratio of aluminum and boron is not limited in particular. In oxide equivalent of aluminum and boron, an aluminum oxide is preferably 50 mass % to 95 mass %. A coating solution like that is described in, for example, Japanese Laid-open Patent Publication No. 06-65754 and Japanese Laid-open Patent Publication No. 06-65755.

Further, the formation amount of the tension applying type insulating film 2 is set to not less than 1 $g/m^2$ nor more than 6 $g/m^2$ per one surface. If the formation amount of the insulating film 2 is less than 1 $g/m^2$, tension is not applied sufficiently, thus being difficult to sufficiently improve the magnetic property in the rolling direction (L direction). On the other hand, if the formation amount of the insulating film 2 is in excess of 6 g/m$^2$, the space factor decreases.

Further, the baking temperature is preferably set to not lower than 800° C. nor higher than 1100° C. If the baking temperature is lower than 800° C., tension is not applied sufficiently, thus being difficult to sufficiently improve the magnetic property in the rolling direction (L direction). On the other hand, if the baking temperature is in excess of 1100° C., the cost is increased significantly, and the stable operation is difficult to be performed.

Through a series of processes as above, the non-oriented electrical steel sheet according to the embodiment may be manufactured. Then, in the non-oriented electrical steel sheet, the external oxide film 3 makes the base iron 1 and the tension applying type insulating film 2 strongly adhere to each other. Therefore, higher tension is applied to further improve the magnetic property in the rolling direction (L direction), and even in the case when various workings (punching, interlocking, and so on) for forming a divided core are performed, peeling off of the insulating film 2 or the like can be suppressed.

Figure 6:
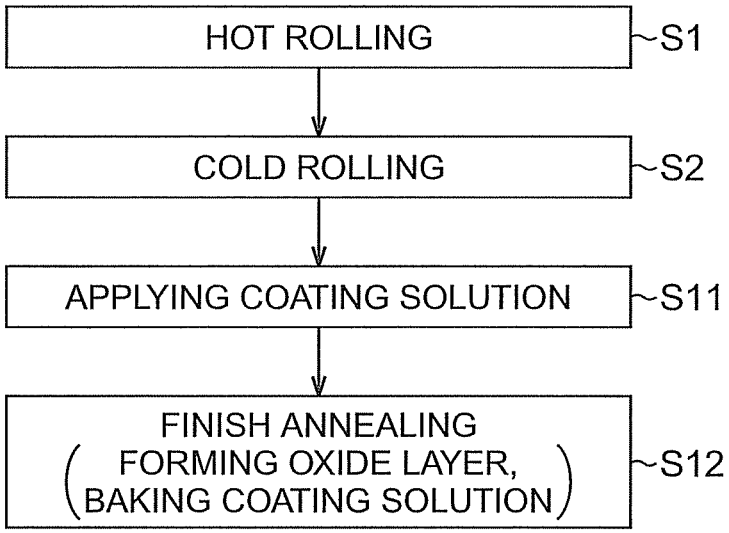
FIG. 6 is a flowchart illustrating another example of the manufacturing method of the non-oriented electrical steel sheet.

Incidentally, in the manufacturing method, the application and baking of the coating solution for the formation of the insulating films 2 (Step S4) are performed after the finish annealing (Step S3). The baking may also be performed in parallel to the finish annealing. That is, as illustrated in FIG. 6, it is also possible that after the cold rolling (Step S2), the coating solution is applied to the cold-rolled steel strip (Step S11) and the finish annealing combined with the baking of the coating solution (Step S12) may be performed.

Further, after the formation of the tension applying type insulating films 2, a coating film made of only resin and/or a coating film composed of an inorganic substance and resin may also be formed on the tension applying type insulating films 2 in order to improve the punching performance when forming a core such as a divided core. That is, the application and baking of a coating solution normally used for forming an insulating film for a non-oriented electrical steel sheet may be performed, and thereby the punching performance can be made better. As the coating solution as above, a coating solution containing chromate and an acrylic resin may be used. For example, a coating solution in which in/to a chromic acid aqueous solution, a metal oxide, a metal hydroxide, and a metal carbonate are dissolved, and further an emulsion type resin is added may be used. A coating solution like that is described in Japanese Examined Patent Application Publication No. 50-15013, for example. Further, a coating solution containing phosphate and an acrylic resin may also be used. For example, a coating solution to which 1 part by mass to 300 parts by mass of an organic resin emulsion is added with respect to 100 parts by mass of phosphate may be used. A coating solution like that is described in Japanese Laid-open Patent Publication No. 06-330338, for example.

EXAMPLE

Next, experiments conducted by the present inventors will be explained. The conditions and so on in these experiments are examples employed for confirming the practicability and the effects of the present invention, and the present invention is not limited to these examples.

First Experiment

First, steel slabs (steel No. 1 to No. 7) each containing various components listed in Table 2 and a balance being composed of Fe and inevitable impurities were hot rolled to manufacture hot-rolled steel strips each having a thickness of 2.5 mm. Next, annealing of the hot-rolled steel strips (hot-rolled sheet annealing) was performed at 900° C. for 1 minute. Thereafter, acid pickling was performed and cold rolling was performed to manufacture cold-rolled steel strips each having a thickness of 0.35 mm.

TABLE 2

| STEEL | COMPONENT (MASS %) | | | |
|---|---|---|---|---|
| No. | Si | Al | Cr | Mn |
| 1 | 3 | 0.3 | <0.01 | 0.5 |
| 2 | 2 | 1.5 | <0.01 | 0.5 |
| 3 | 2 | 2 | <0.01 | 0.5 |
| 4 | 2 | 2 | 2 | 0.5 |
| 5 | 2 | 2 | 1 | 0.5 |
| 6 | 1 | 1 | <0.01 | 0.5 |
| 7 | 3 | 1.2 | <0.01 | 0.5 |

Subsequently, finish annealing was performed under the condition listed in Table 3, and the main component and thickness of each of formed external oxide films (oxide layers) were examined. The identification of the main component of the external oxide film was performed with an infrared reflection-absorption spectrum, and the thickness of the external oxide film was examined by transmission electron microscopic observation.

Next, under the condition listed in Table 3, application and baking of a coating solution were performed to form tension applying type insulating films. In Table 3, in the column of "COATING SOLUTION," "S" signifies that a coating solution containing colloidal silica, aluminum phosphate, and chromic acid was used, and "A" signifies that a coating solution containing boric acid and an alumina sol was used.

Then, the adhesiveness of each of the insulating films was evaluated. The result is also listed in Table 3. In Table 3, "X" in the column of "ADHESIVNESS" signifies that in the case of a non-oriented electrical steel sheet being wound around a round bar having a diameter of 30 mm, the insulating film was peeled off. Further, "○" signifies that in the case of the non-oriented electrical steel sheet being wound around a round bar having a diameter of 30 mm, the insulating film was not peeled off, but in the case of the non-oriented electrical steel sheet being wound around a round bar having a diameter of 20 mm, the insulating film was peeled off. "◎" signifies that even in the case of the non-oriented electrical steel sheet being wound around a round bar having a diameter of 20 mm, the insulating film was not peeled off.

Further, the evaluation of a core loss improvement rate in the L direction was also performed. In the evaluation, a core loss value $W_1$ (W10/50) of each of the non-oriented electrical steel sheets manufactured by the above-described method was measured to be compared to a core loss value $W_0$ (W10/50) of a reference sample. As the reference sample, one on which in place of the tension applying type insulating films, insulating films were formed by application and baking of a coating solution containing phosphate and an acrylic resin described in Japanese Laid-open Patent Publication No. 06-330338 was used. The reason why such evaluation was performed is because the absolute value of core loss depends on the component and process condition. The result is also listed in Table 3. The numerical value in the column of "CORE LOSS IMPROVEMENT RATE IN L DIRECTION" is the value expressed by "$(W_0-W_1)/W_0$."

TABLE 3

| STEEL No. | CONDITION OF FINISH ANNEALING: PARTIAL PRESSURE ($P_{H2O}/P_{H2}$) | CONDITION OF FINISH ANNEALING: SOAKING TEMPERATURE (° C.) | EXTERNAL OXIDE FILM (OXIDE LAYER): MAIN COMPONENT | EXTERNAL OXIDE FILM (OXIDE LAYER): THICKNESS (μm) | TENTION APPLYING TYPE INSULATING FILM: COATING SOLUTION | TENTION APPLYING TYPE INSULATING FILM: AMOUNT ($g/m^2$) | TENTION APPLYING TYPE INSULATING FILM: BAKING TEMPERATURE (° C.) | ADHESIVENESS | CORE LOSS IMPROVEMENT RATE IN L DIRECTION | NOTE |
|---|---|---|---|---|---|---|---|---|---|---|
| 1 | 0.1 | 950 | (INTERNAL OXIDE LAYER) | | S | 5 | 850 | X | 0.07 | COMPARATIVE EXAMPLE |
| | 0.03 | 800 | $SiO_2$ | 0.01 | S | 5 | 850 | ○ | 0.16 | EXAMPLE |
| | 0.03 | 950 | $SiO_2$ | 0.02 | A | 6 | 900 | ○ | 0.18 | EXAMPLE |
| | 0.03 | 750 | $SiO_2$ | 0.002 | S | 3 | 850 | X | 0.07 | COMPARATIVE EXAMPLE |
| | 0.03 | 950 | $SiO_2$ | 0.02 | A | 0.5 | 900 | ○ | 0.1 | COMPARATIVE EXAMPLE |
| 2 | 0.1 | 950 | (INTERNAL OXIDE LAYER) | | S | 3 | 850 | X | 0.06 | COMPARATIVE EXAMPLE |
| | 0.05 | 800 | $Al_2O_3$ | 0.02 | S | 1 | 800 | ◎ | 0.18 | EXAMPLE |
| | 0.05 | 950 | $Al_2O_3$ | 0.1 | A | 3 | 900 | ◎ | 0.19 | EXAMPLE |
| | 0.05 | 750 | $Al_2O_3$ | 0.005 | S | 3 | 850 | X | 0.07 | COMPARATIVE EXAMPLE |
| | 0.05 | 990 | $Al_2O_3$ | 0.02 | A | 0.5 | 900 | ○ | 0.08 | COMPARATIVE EXAMPLE |
| 3 | 0.06 | 1100 | $Al_2O_3$ | 0.5 | A | 5 | 1100 | ◎ | 0.2 | EXAMPLE |
| | 0.06 | 1100 | $Al_2O_3$ | 0.5 | A | 5 | 750 | ◎ | 0.1 | COMPARATIVE EXAMPLE |
| | 0.06 | 1150 | $Al_2O_3$ | 0.7 | A | 3 | 900 | X | 0.06 | COMPARATIVE EXAMPLE |
| 4 | 0.2 | 950 | (INTERNAL OXIDE LAYER) | | S | 5 | 850 | X | 0.07 | COMPARATIVE EXAMPLE |
| | 0.15 | 800 | $(Al, Cr)_2O_3$ | 0.02 | S | 1 | 800 | ◎ | 0.19 | EXAMPLE |
| | 0.01 | 950 | $(Al, Cr)_2O_3$ | 0.1 | A | 3 | 900 | ◎ | 0.19 | EXAMPLE |
| | 0.1 | 750 | $(Al, Cr)_2O_3$ | 0.005 | S | 3 | 850 | X | 0.09 | COMPARATIVE EXAMPLE |
| | 0.1 | 950 | $(Al, Cr)_2O_3$ | 0.02 | A | 0.5 | 900 | ○ | 0.1 | COMPARATIVE EXAMPLE |
| | 0.1 | 1100 | $(Al, Cr)_2O_3$ | 0.9 | A | 3 | 900 | X | 0.07 | COMPARATIVE EXAMPLE |
| 5 | 0.05 | 1000 | $Al_2O_3$ | 0.2 | A | 6 | 1000 | ◎ | 0.21 | EXAMPLE |
| 6 | 0.01 | 950 | $SiO_2$ | 0.02 | S | 5 | 850 | ○ | 0.18 | EXAMPLE |
| 7 | 0.01 | 1000 | $Al_2O_3$ | 0.03 | A | 3 | 900 | ◎ | 0.19 | EXAMPLE |
| | 0.1 | 1000 | (INTERNAL OXIDE LAYER) | | S | 3 | 850 | X | 0.05 | COMPARATIVE EXAMPLE |

As listed in Table 3, in the case of the condition of the present invention being satisfied, the adhesiveness of the insulating film and the magnetic property in the L direction were extremely good. Further, in the case when the external oxide film was not formed and an internal oxide layer was formed, the adhesiveness was extremely low.

Second Experiment

The steel slabs of steel No. 1, No. 3, and No. 4 listed in Table 2 were hot rolled to manufacture hot-rolled steel strips each having a thickness of 2.5 mm. Next, annealing of the hot-rolled steel strips (hot-rolled sheet annealing) was performed at 900° C. for 1 minute. Thereafter, acid pickling was performed and cold rolling was performed to manufacture cold-rolled steel strips each having a thickness of 0.35 mm.

Subsequently, application of a coating solution was performed under the condition listed in Table 4. Next, finish annealing combined with baking of the coating solution was performed under the condition listed in Table 4. That is the processes according to the flowchart illustrated in FIG. 6 were performed in the second experiment, while the processes according to the flowchart illustrated in FIG. 5 were performed in the first experiment. Then, similarly to the first experiment, the adhesiveness of each of insulating films and the core loss improvement rate in the L direction were evaluated. The result is also listed in Table 4.

TABLE 4

| STEEL No. | TETENTION APPLYING TYPE INSULATING FILM, FINISH ANNEALING (BAKING): COATING SOLUTION | AMOUNT ($g/m^2$) | PARTIAL PRESSURE ($P_{H2O}/P_{H2}$) | SOAKING TEMPERATURE (° C.) | ADHESIVENESS | CORE LOSS IMPROVEMENT RATE IN L DIRECTION | NOTE |
|---|---|---|---|---|---|---|---|
| 1 | S | 5 | 0.03 | 800 | ○ | 0.16 | EXAMPLE |
| | A | 6 | 0.03 | 950 | ○ | 0.18 | EXAMPLE |
| 3 | S | 5 | 0.06 | 1100 | ◎ | 0.2 | EXAMPLE |
| | A | 5 | 0.06 | 1100 | ◎ | 0.2 | EXAMPLE |

TABLE 4-continued

| STEEL No. | TETENTION APPLYING TYPE INSULATING FILM, FINISH ANNEALING (BAKING) COATING SOLUTION | AMOUNT ($g/m^2$) | PARTIAL PRESSURE ($P_{H2O}/P_{H2}$) | SOAKING TEMPERATURE (° C.) | ADHESIVENESS | CORE LOSS IMPROVEMENT RATE IN L DIRECTION | NOTE |
|---|---|---|---|---|---|---|---|
| 4 | S | 1 | 0.15 | 800 | ◎ | 0.19 | EXAMPLE |
| | A | 3 | 0.01 | 950 | ◎ | 0.19 | EXAMPLE |

As listed in Table 4, also in the case when the finish annealing combined with the baking of the coating solution was performed according to the flowchart illustrated in FIG. 6, the extremely good adhesiveness of the insulating film and the extremely good magnetic property in the L direction were able to be obtained.

INDUSTRIAL APPLICABILITY

The present invention may be utilized in, for example, an industry of manufacturing electrical steel sheets and an industry in which electrical steel sheets are used.

The invention claimed is:

1. A non-oriented electrical steel sheet comprising:

a base iron containing:

Si, Al, and Cr: not less than 2 mass % and not more than 6 mass % in total content, Mn: not less than 0.1 mass % and not more than 1.5 mass %, C: equal to or less than 0.005 mass %, and a balance of Fe and inevitable impurities;

an oxide layer containing $Al_2O_3$ or $(Al, Cr)_2O_3$;

wherein the oxide layer has a thickness of not less than 0.01 μm and not more than 0.5 μm; and wherein the oxide layer is formed on a surface of the base iron; and a tension-applying type insulating film of not less than 1 $g/m^2$ and not more than 6 $g/m^2$ on the surface of the base iron.

2. The non-oriented electrical steel sheet according to claim 1, wherein the total content of Al and Cr of the base iron is equal to or more than 0.8 mass %.

3. The non-oriented electrical steel sheet according to claim 1, wherein the insulating film is formed by baking of a coating solution containing phosphate and colloidal silica.

4. The non-oriented electrical steel sheet according to claim 1, wherein the insulating film is formed by baking of a coating solution containing boric acid and an alumina sol.

5. The non-oriented electrical steel sheet according to claim 2, wherein the insulating film is formed by baking of a coating solution containing phosphate and colloidal silica.

6. The non-oriented electrical steel sheet according to claim 2, wherein the insulating film is formed by baking of a coating solution containing boric acid and an alumina sol.

* * * * *

UNITED STATES PATENT AND TRADEMARK OFFICE

CERTIFICATE OF CORRECTION

PATENT NO. : 9,187,830 B2
APPLICATION NO. : 13/577946
DATED : November 17, 2015
INVENTOR(S) : Yamazaki et al.

It is certified that error appears in the above-identified patent and that said Letters Patent is hereby corrected as shown below:

Specification

Column 10, line 39, change "ADHESIVNESS" to -- "ADHESIVENESS" --; and

Columns 11 and 12, lines 1 through 39, Table 3, steel no. 2, column "soaking temperature (°C)", row 15, change "990" to -- "950" --.

Signed and Sealed this
Thirty-first Day of May, 2016

Michelle K. Lee

Michelle K. Lee
*Director of the United States Patent and Trademark Office*